US005560982A

United States Patent [19]

Sato

[11] Patent Number: 5,560,982

[45] Date of Patent: Oct. 1, 1996

[54] INK JET RECORDING SHEET

[75] Inventor: Kazuo Sato, Tokyo, Japan

[73] Assignee: Harris Corporation, Melbourne, Fla.

[21] Appl. No.: 183,340

[22] Filed: Jan. 19, 1994

[30] Foreign Application Priority Data

Jan. 27, 1993 [JP] Japan ..... 5-029667

[51] Int. Cl.[6] ..... B41M 5/00

[52] U.S. Cl. ..... 428/216; 428/195; 428/334; 428/335; 428/336

[58] Field of Search ..... 428/195, 411.1, 428/213, 215, 216, 334–336

[56] References Cited

U.S. PATENT DOCUMENTS 4,785,313 11/1988 Higuma et al. ..... 346/1.1

5,212,008 5/1993 Malhotra et al. ..... 428/195

*Primary Examiner*—Pamela R. Schwartz

*Attorney, Agent, or Firm*—Rogers & Killeen

[57] ABSTRACT

An ink jet recording sheet having a base and an ink receiving layer formed on the base. An image is formed on the ink receiving layer to be observed from the base side. The ink jet recording sheet is designed to have improved ink permeability, to obtain an image having a high developed color density and having an improved fixation effect, and to enable the image to be also appreciated from the ink receiving layer side. The base is formed of a transparent film and the ink receiving layer is formed at least one side of the base. The ink receiving layer is formed of an ink solvent fixation layer formed on the base and an ink dyestuff fixation layer formed on the ink solvent fixation layer.

11 Claims, No Drawings

INK JET RECORDING SHEET

BACKGROUND OF THE INVENTION

1. Field of the Invention

This invention relates to a recording sheet on which an ink jet printer prints a monochromatic or full-color image at a high speed by jetting droplets of water-color ink or the like and, more particularly, to an ink jet recording sheet suitable for observing an image from the reverse side of a base.

2. Description of the Related Art

As recording methods, thermal fusion transfer methods, thermal sublimation transfer methods, electrophotographic methods using a toner as a medium, ink jet methods and the like are known. Recently, the application of ink jet recording methods has been increased because this kind of recording method is advantageous in terms of noiselessness during recording, high-speed printing performance, color recording facility, and adaptability to recording of a large image.

The following are qualities required in an ink jet recording sheet:

(1) an improved ink absorptivity and a blurring-free property, (2) improved smoothness and glossiness, (3) sheet/image waterproofness such that ink does not run or spread when water is attached to the sheet, (4) stability in size such that the sheet does not slacken when it absorbs a large amount of water, and (5) a high developed color density and improved sharpness of an image.

Various improvement techniques have been developed to obtain such qualities. With respect to a sheet having an image seen from the rear side, i.e., a back print sheet, the inventions disclosed in Japanese Patent Laid-Open Publication Nos. 62-222876, 62-242576 and 63-34176 are known.

However, if an ink jet printer is used to print an image on the above-described conventional recording sheets, most of dyestuff components in ink pass through an ink receiving layer to reach a base. The developed color density of the resulting image is not high enough to suitably appreciate the image when the image is seen from the ink receiving layer, although the image can be seen as a good image when seen from the reverse side of the base.

This problem will be described in more detail. The ink receiving layer in the conventional recording sheets is formed of an ink permeable layer and an ink fixation layer. The ink permeable layer is provided only for passage of ink dyestuffs and an ink solvent. The ink fixation layer is provided on the basis of a concept of achieving an ink absorbing effect only by using a water absorptive resin. Therefore, the ink absorption layer does not absorb organic solvent components such as diethylene glycol, triethylene glycol monomethyl ether and triethylene glycol monoethyl ether, although it absorbs water in the ink solvent. Accordingly, the organic solvent components stay on the interface between the ink permeable layer and the ink fixation layer. On the other hand, the ink dyestuffs have a property such as to cohere basically to the organic solvent and are, therefore, fixed at the interface between the ink permeable layer and the ink fixation layer. However, the fixation of the dyestuffs is considerably unstable since the ink permeable layer has no dyestuff fixing function.

SUMMARY OF THE INVENTION

In view of the above-described circumstances, an object of the present invention is to provide an ink jet recording sheet having an improved ink fixation characteristic and capable of obtaining an image having improved sharpness and a high developed color density when seen from the reverse side of a base.

To achieve this object, according to the present invention, there is provided an ink jet recording sheet having a base formed of a transparent plastic film and an ink receiving layer formed on at least one of two surfaces of the base. The ink receiving layer is formed of an ink solvent fixation layer formed on the base and an ink dyestuff fixation layer formed on the ink solvent fixation layer.

The inventor of the present invention has eagerly conducted studies to achieve the present invention based on a finding with respect to use of a recording sheet described below. An ink receiving layer is formed on a base which is formed of a transparent plastic film. The ink receiving layer is formed of two layers: an ink solvent fixation layer formed directly on the base and an ink dyestuff layer formed on the ink solvent fixation layer in such a manner that if an image is printed on these layers by using an ink jet printer, a dyestuff in an ink is fixed in the ink dyestuff fixation layer while organic solvent components of an ink solvent are absorbed and fixed in the ink solvent fixation layer, when the ink passes through the ink dyestuff fixation layer. A part of the dyestuff fixed in the ink dyestuff fixation layer starts moving gradually toward organic solvent components fixed in the ink solvent fixation layer to be fixed in the ink solvent fixation layer at an interface on the base. As a result, the developed color density of the image seen from the reverse side of the base is increased and the image is remarkably improved in sharpness. Since the remaining dyestuff is also fixed in the ink dyestuff fixation layer, the developed color density and the sharpness of the image when the image is seen from the ink receiving layer side are also high. Further, the dyestuff is not easily faded and the dyestuff fixation effect is improved because the ink dyestuff fixation layer has a dyestuff fixing function while the dyestuff is fixed in the ink solvent fixation layer.

The present invention will be described in more detail.

A recording sheet in accordance with the present invention is obtained by a method described below.

As a transparent plastic film forming the base, a transparent thermoplastic resin film, a polyvinyl alcohol film or an oriented film of these films is used.

The thermoplastic resin film may be a film of polyethylene terephthalate, polypropylene, polystyrene, polyvinyl chloride, polymethyl methacrylate, polyethylene, polycarbonate or the like, or a film of such a material having an under coat layer for improving adhesion between a surface of the film and an ink fixation layer or having a surface worked by corona discharge or other means.

An ink receiving layer is formed on the base. In accordance with the present invention, the ink receiving layer is formed of two layers, i.e., an ink dyestuff fixation layer and an ink solvent fixation layer.

The ink dyestuff fixation layer is mainly formed of a binder, a filler and a dyestuff fixer for providing a dyestuff fixing effect. For example, a material used as a binder for the ink dyestuff fixation layer may be selected from starches, such as oxidized starch and esterified starch, cellulose derivatives, such as carboxymethyl cellulose and hydroxyethyl cellulose, casein, gelatin, soybean protein, polyvinyl alcohol, derivatives of polyvinyl alcohol, conjugated diene polymer latexes, such as styrene-butadiene copolymer and methylmethacrylate-butadiene copolymer, acrylic polymer latexes, such as polymers or copolymers of acrylic ester and methacrylic ester, and vinyl copolymer latexes, such as vinyl chloride-vinyl acetate copolymer and the like.

As a filler for the ink dyestuff fixation layer, any of organic and inorganic fillers may be used. For example, polystyrene, polymethylmethacrylate, styrene-acryl copolymer, synthetic silica, clay, talc, diatomite, calcium carbonate, baked kaolin, titanium oxide, zinc oxide or satin white may be used preferably.

The weight of the filler relative to the weight of the binder varies greatly according to the ink ejection rate of a printer used. However, the weight of the filler is, preferably, 1 to 9 times and, more preferably, 2 to 8 times that of the binder. If it is smaller than the binder weight, the ink absorption rate is so small that an image flow is caused. If it is greater than 9 times of the binder weight, the bonding strength of the binder is so reduced that the surface layer is easily separated or scraped off.

A dyestuff fixer preferably used to provide a dyestuff fixing effect in the ink dyestuff fixation layer is selected from cationic polyether quaternary ammonium salt, quaternary polyammonium salt, polyamide epichlorohydrin and styrene ethyl trimethyl methacrylate ammonium chloride fixers, and anion macromolecular aromatic sulphonic acid condensate fixers according to characteristics of dyestuffs. The content of the dyestuff fixer is 0.1 to 50 wt % and, more preferably, 0.5 to 30 wt % of the weight of the filler.

The thickness of the ink dyestuff fixation layer is 5 to 80 μm and, more preferably, 50 to 60 μm, and may be determined according to the specific ink ejection rate of printers.

The ink solvent fixation layer is mainly formed of a water absorbing resin and an electroconductive macromolecular material. A water absorbing resin preferably used for the ink solvent fixation layer is selected from gelatin, casein, starch, carboxymethyl cellulose, hydroxyethyl cellulose, polyethylene imine, polyvinyl pyrolidone, polyvinyl acetal, polyvinyl alcohol, ethylenevinyl acetate copolymer, polyester and other resins. However, it is not possible to achieve the above-mentioned object of the invention only by using the water absorbing resin, since the water absorbing resin cannot absorb and fix organic solvent components in an ink solvent, although it can absorb water in the ink solvent.

Examples of organic solvent components constituting an ink solvent are alkyl alcohols having 1 to 4 carbon atoms, such as methyl alcohol, ethyl alcohol, n-propyl alcohol, isopropyl alcohol, n-butyl alcohol and isobutyl alcohol; amides, such as dimethylformamide and dimethylacetamide; ketones or ketone alcohols, such as acetone and diacetone alcohol; ethers, such as tetrahydrofuran and dioxane; polyalkylene glycols, such as polyethylene glycol and polypropylene glycol; alkylene glycols having 2 to 6 alkylene groups, such as ethylene glycol, propylene glycol, butylene glycol, triethylene glycol, thiodiglycol, hexylene glycol and diethylene glycol; lower alkyl ethers of polyvalent alcohols, such as ethylene glycol methyl ether, diethylene glycol methyl ether and triethylene glycol monomethyl ether.

Organic solvents referred to with resect to the present invention, among these various water-soluble organic solvents, are polyvalent alcohol, such as diethylene glycol, and lower alkyl ethers of polyvalent alcohols, such as triethylene glycol monomethyl ether and triethylene glycol monoethyl ether.

In order to absorb and fix the above-mentioned organic solvents in the ink solvent fixation layer, it is necessary to provide an electroconductive macromolecular compound in the ink solvent fixation layer. The ionicity of such a compound is not particularly limited to a cationic or anionic ionicity. For example, an electroconductive macromolecular compound for the ink solvent fixation layer may be selected from cationic compounds including quaternary polyammonium salt type styrene copolymer, quaternary polyammonium salt type aminoalkyl (metha)acrylate copolymer and quaternary polyammonium salt type diarylamine copoymer, and anionic compounds including sulphonate type styrene copolymer. The electroconductive macromolecular content is 1 to 50 % and, more preferably, 2 to 30 % of the water absorbing resin in terms of solid component percentage. Also, inorganic and/or organic fillers or the like may be added for the purpose of preventing blocking, as long as the desired transparency is maintained.

Each of the ink solvent fixation layer and the ink dyestuff fixation layer may be formed by repeatedly applying the material with an ordinary well-known coating means, such as a gravure coater, a knife coater, a roll coater or a wire bar coater.

The thickness of the ink solvent fixation layer is 1 to 15 μm and, more preferably, 2 to 10 μm. If the thickness is smaller than 1 μm, the solvent absorption is insufficient. If the thickness is greater than 15 μm, the solvent absorbing effect is saturated.

Further, to enable an image to be appreciated from the ink receiving layer in another aspect of the invention, a reflection density measured on the ink receiving layer side, assumed as x, and a reflection density measured on the base side, assumed as y, are controlled so that $x/y \geqq 0.6$ and, more preferably, $x/y \geqq 0.7$.

Each of the reflection densities x and y is set within an ordinary image appreciable range, e.g., the range of 1.0 to 1.4 with respect to yellow, the range of 1.0 to 1.45 with respect to magenta, the range of 0.85 to 1.3 with respect to cyan and the range of 1.2 to 1.75 with respect to black.

In the ink jet recording sheet of the invention obtained in the above-described manner, the ink receiving layer is formed of an ink solvent fixation layer formed on the base and an ink dyestuff fixation layer formed on the ink solvent fixation layer, and dyestuffs are fixed in the ink solvent fixation layer and are protected by upper ink dyestuff fixation layer. Therefore, the dyestuff fixation is improved and an image having a high developed color density can be imaged as seen from the reverse side of the base. The image can also be appreciated from the ink receiving layer side, that is, the image can be appreciated from the both side. The recording sheet of the present invention is thus suitable and convenient for recording.

The present invention will be described with respect to examples thereof.

Example 1

A coating liquid was prepared by adding 10 parts by weight (hereinafter referred to simply as "parts") of cationic quaternary ammonium salt type styrene copolymer (CHEMISTAT 6300, a product from Sanyo Kasei Kogyo, having a 33% solid content) to 150 parts of an aromatic polyvinyl acetal resin (S-LEC KX-1, a product from Sekisui Kagaku Kogyo, having an 8% solid content). The coating liquid was applied to a surface of a transparent polyester film processed by corona discharge and having a thickness of 75 μm by using a bar coater, followed by drying. A transparent ink solvent fixation layer having a thickness of 3 μm was thereby formed.

Next, 24 parts of diatomite (RADIOLITE F, a product from Showa Kagaku Kogyo) was dispersed in 64 parts of polyvinyl alcohol (PVA R1130, a product from KURARAY), and 10 parts of a polyamide epichlorohydrin fixer (POLYFIX 301, a product from Showa Kobunshi, having a 30% solid component) was added as a dyestuff fixer to the dispersion liquid. The liquid was then agitated sufficiently to obtain a coating liquid. This coating liquid was applied to the ink solvent fixation layer by a roll coater and was dried to form an ink dyestuff fixation layer having a thickness of 45 μm. A recording sheet representing an example of the present invention was obtained in this manner.

An image in four colors: yellow, magenta, cyan and black is printed on this sheet by using an ink jet printer (KALEIDA, a product from Fuji Shashin film Kogyo) and was observed from the reverse side of the base. A pattern image having an improved developed color density was thereby observed. The corresponding image seen from the ink receiving layer side had a developed color density and color qualities high enough to suitably appreciate the image. Further, 2 hours after the printing, the reflection density of the print was measured with a Macbeth illuminometer RD-918. Table 1 shows values thereby measured.

TABLE 1

| | Yellow | Magenta | Cyan | Black |
|---|---|---|---|---|
| Base reverse side (y) | 1.27 | 1.33 | 1.18 | 1.61 |
| Ink receiving layer side (x) | 1.10 | 1.10 | 0.95 | 1.26 |
| x/y | 0.87 | 0.83 | 0.81 | 0.78 |

Example 2

A coating liquid was prepared by adding 20 parts of cationic quaternary ammonium salt type styrene copolymer used in Example 1 to 100 parts-of an ethylene-polyvinyl acetate copolymer resin (POLYSOL EVA AD-5, a product from Showa Kobunshi, having a 56% solid content). The coating liquid was applied to a surface of a transparent polyester film processed by corona discharge and having a thickness of 75 μm by using a bar coater, followed by drying. A transparent ink solvent fixation layer having a thickness of 5 μm was thereby formed.

Next, 24 parts of diatomite was dispersed in 64 parts of polyvinyl alcohol used in Example 1, and 5 parts of quaternary ammonium salt (LEVOGEN FW, a product from Bayer, having an 18% solid content) was added as a dyestuff fixer to the dispersion liquid. The liquid was then agitated sufficiently to obtain a coating liquid. This coating liquid was applied to the ink solvent fixation layer by a roll coater and was dried to form an ink dyestuff fixation layer having a thickness of 48 μm. Another example of the recording sheet of the present invention was obtained in this manner.

An image was printed on this recording sheet in the same manner as in Example 1. The same effect as that of Example 1 was achieved. The reflection density was measured 2 hours after the printing in the same manner as in Example 1. Table 2 shows values thereby measured.

TABLE 2

| | Yellow | Magenta | Cyan | Black |
|---|---|---|---|---|
| Base reverse side (y) | 1.30 | 1.35 | 1.20 | 1.65 |
| Ink receiving layer side (x) | 1.13 | 1.11 | 0.98 | 1.28 |
| x/y | 0.87 | 0.82 | 0.82 | 0.77 |

Example 3

Another example of the recording sheet of the present invention was obtained in the same manner as in Example 1 except that, for the ink solvent fixation layer of Example 1, 10 parts of anionic sulphonate type styrene copolymer (CHEMISTAT 6120, a product from Sanyo Kasei Kogyo, having a 30% solid content) was added in place of the cationic quaternary ammonium salt type styrene copolymer.

An image was printed on this recording sheet in the same manner as in Example 1. The same effect as that of Example 1 was achieved. The reflection density was measured 2 hours after the printing, in the same manner as in Example 1. Table 3 shows values thereby measured.

TABLE 3

| | Yellow | Magenta | Cyan | Black |
|---|---|---|---|---|
| Base reverse side (y) | 1.29 | 1.32 | 1.19 | 1.63 |
| Ink receiving layer side (x) | 1.11 | 1.12 | 0.96 | 1.29 |
| x/y | 0.86 | 0.85 | 0.80 | 0.79 |

Comparative Example 1

A coating liquid was prepared in the same manner as the coating liquid of Example 1 except that the polyamide epichlorohydrin fixer was not used. Printing was performed in the same manner as Example 1. Two hours after the printing, the reflection density was measured. Table 4 shows values thereby measured.

As is apparent from Table 4, the density of the image seen from the ink receiving layer side was seriously low and the image was not worth appreciation from this side.

TABLE 4

| | Yellow | Magenta | Cyan | Black |
|---|---|---|---|---|
| Base reverse side (y) | 1.37 | 1.40 | 1.24 | 1.70 |
| Ink receiving layer side (x) | 0.50 | 0.52 | 0.41 | 0.62 |
| x/y | 0.36 | 0.37 | 0.33 | 0.36 |

Comparative Example 2

A coating liquid was prepared in the same manner as the coating liquid of Example 1 except that the cationic quaternary ammonium salt type styrene copolymer was not used. Printing was performed in the same manner as Example 1. The print was left in a room condition at 25° C. and 50% RH for 100 hours. As a result, fading of ink dyestuffs proceeded so that both the density on the base reverse side and the density on the ink receiving layer side were considerably reduced and the image was not worth appreciation from each side. Table 5 shows measured values of this example.

TABLE 5

| | Yellow | Magenta | Cyan | Black |
|---|---|---|---|---|
| Base reverse side (y) | 0.52 | 0.54 | 0.48 | 0.71 |
| Ink receiving layer side (x) | 0.42 | 0.77 | 0.37 | 0.68 |
| x/y | 0.80 | 0.87 | 0.77 | 0.95 |

What is claimed is:

1. An ink jet recording sheet comprising:

a base formed of a transparent plastic film; and an ink receiving layer formed on at least one of two surfaces of said base, said ink receiving layer including an ink solvent fixation layer formed on said base and an ink dyestuff fixation layer formed on said ink solvent fixation layer, said ink solvent fixation layer comprising a water absorbing resin and an electroconductive macromolecular material for absorbing organic solvent components of a solvent in an ink from said ink dyestuff fixation layer, and said ink dyestuff fixation layer comprising a binder, a filler, and a dye fixing agent for absorbing ink dyestuff in an ink received thereon, wherein said dye fixing agent is 0.1 to 50 weight % of the weight of said filler, the thickness of said ink dyestuff fixation layer is 5 to 80μm, said electroconductive macromolecular material content is 1 to 50% of said water absorbing resin in terms of solid component percentage, and the thickness of said ink solvent fixation layer is 1 to 15 μm.

2. An ink jet recording sheet according to claim 1, wherein when an image is recorded on a surface of said ink receiving layer by ink jetting, a reflection density x measured from the ink receiving layer side and a reflection density y measured from the base side are in a relationship: $x/y \geqq 0.6$.

3. An ink jet recording sheet according to claim 1, wherein said electroconductive macromolecular material comprises (a) a cationic compound selected from the group consisting of the following cationic compounds, quaternary polyammonium salt styrene copolymer, quaternary polyammonium salt aminoalkyl (metha)acrylate copolymer and quaternary polyammonium salt diarylamine copolymer, or (b) the following anionic compound, sulphonate styrene copolymer.

4. The ink jet recording sheet of claim 1 wherein the weight ratio of said filler to said binder is in the range of 1:1 to 1:9.

5. The ink jet recording sheet of claim 1 wherein one said ink receiving layer is formed on each of the two surfaces of the base.

6. An ink jet recording sheet comprising:

a transparent plastic film;

an ink solvent fixation layer on said base for fixing an ink solvent, said ink solvent fixation layer comprising a water absorbing resin and an electroconductive macromolecular material for absorbing ink organic solvents; and an ink dyestuff fixation layer on said ink solvent fixation layer for fixing an ink dye, said ink dyestuff fixation layer comprising a binder, a filler and a dye fixing agent, wherein said dye fixing agent is 0.1 to 50 weight % of the weight of said filler, the thickness of said ink dyestuff fixation layer is 5 to 80μm, said electroconductive macromolecular material content is 1 to 50% of said water absorbing resin in terms of solid component percentage, and the thickness of said ink solvent fixation layer is 1 to 15 μm.

7. The sheet of claim 6 wherein the weight ratio of said filler to said binder is in the range of 1:2 to 1:8, the weight ratio of said filler to said dye fixing agent is in the range of 1:200 to 3:10, said ink dyestuff fixation layer is 50 to 60 μm thick, and said ink solvent fixation layer is 2 to 10 μm thick.

8. In an ink jet recording sheet having a transparent plastic substrate with an ink receiving layer on a first side thereof so that ink images may be clearly viewed from both sides of the substrate, the improvement wherein said ink receiving layer comprises:

an ink dyestuff fixation layer for fixing an ink dye therein that is spaced from the plastic substrate by an ink solvent fixation layer for fixing an ink solvent therein which permits ink applied to the ink receiving layer to be clearly viewed from both sides of the plastic substrate, said ink solvent fixation layer comprising a water absorbing resin and an electroconductive macromolecular material for absorbing ink organic solvents, and said ink dyestuff fixation layer comprising a binder, a filler, and a dye fixing agent for absorbing ink dyestuff in an ink received thereon, wherein a portion of the ink dyestuff from said ink dyestuff fixation layer migrates to an interface between said base and said ink solvent fixation layer when ink is applied to the ink jet recording sheet, and wherein said dye fixing agent is 0.1 to 50 weight % of the weight of said filler, the thickness of said ink dyestuff fixation layer is 5 to 80μm, said electroconductive macromolecular material content is 1 to 50% of said water absorbing resin in terms of solid component percentage, and the thickness of said ink solvent fixation layer is 1 to 15 μm.

9. The ink jet recording sheet of claim 8 wherein the ink dyestuff fixer is selected from the group consisting of a cationic polyether quaternary ammonium salt, a quaternary polyammonium salt, a polyamide epichlorohydrin, a styrene ethyl trimethyl methacrylate ammonium chloride, and anion macromolecular aromatic sulphonic acid condensate.

10. The ink jet recording sheet of claim 9 wherein said electroconductive macromolecular material comprises (a) a cationic compound selected from the group consisting of the following cationic compounds, quaternary polyammonium salt styrene copolymer, quaternary polyammonium salt aminoalkyl (metha)acrylate copolymer and quaternary polyammonium salt diarylamine copolymer, or (b) the following anionic compound, sulphonate styrene copolymer.

11. The ink jet recording sheet of claim 10 wherein the solid component ratio of electroconductive macromolecular material to water absorbing resin is in the range of 1:50 to 3:10.

* * * * *